US005195249A

United States Patent [19]

Jackson

[11] Patent Number: 5,195,249

[45] Date of Patent: Mar. 23, 1993

[54] WALL PANEL TEMPLATE

[76] Inventor: Tommy Jackson, 249 Lincoln Ave., Syracuse, N.Y. 13204

[21] Appl. No.: 822,140

[22] Filed: Jan. 17, 1992

[51] Int. Cl.[5] ..... G01B 3/14

[52] U.S. Cl. ..... 33/528; 33/1 B; 33/1 G; 33/563; 33/DIG. 10; 52/746

[58] Field of Search ..... 33/1 B, 1 G, 1 K, 1 AA, 33/526, 528, 562, 563, 566, DIG. 10, 1 R, 11, 12; 52/745, 746

[56] References Cited

U.S. PATENT DOCUMENTS 1,362,726 12/1920 Mason .
3,913,235 10/1975 Tenneson et al. .
4,114,346 9/1978 Kelly ..... 33/17 R X
4,212,110 7/1980 Hill, Jr. .
4,228,592 10/1980 Badger .
4,353,759 10/1982 Stallings .
4,372,050 2/1983 Eisenhauer .
4,730,398 3/1988 Stanton .
4,779,346 10/1988 Schafer ..... 33/1 B

FOREIGN PATENT DOCUMENTS 590105 7/1947 United Kingdom ..... 33/1 B

OTHER PUBLICATIONS

Keuffel & Esser Co., "Graph Sheets", 1949, p. 47.

*Primary Examiner*—William A. Cuchlinski, Jr.
*Assistant Examiner*—Alvin Wirthlin
*Attorney, Agent, or Firm*—Wall and Roehrig

[57] ABSTRACT

A disposable paper template for accurately marking building panels to facilitate cutouts for windows, doors and other objects in a building wall. The template is formed from a thin transparent paper and is sized to conform to the panel for which it is to be used. The template carries thereon level lines and measuring scales to facilitate alignment and use.

3 Claims, 2 Drawing Sheets

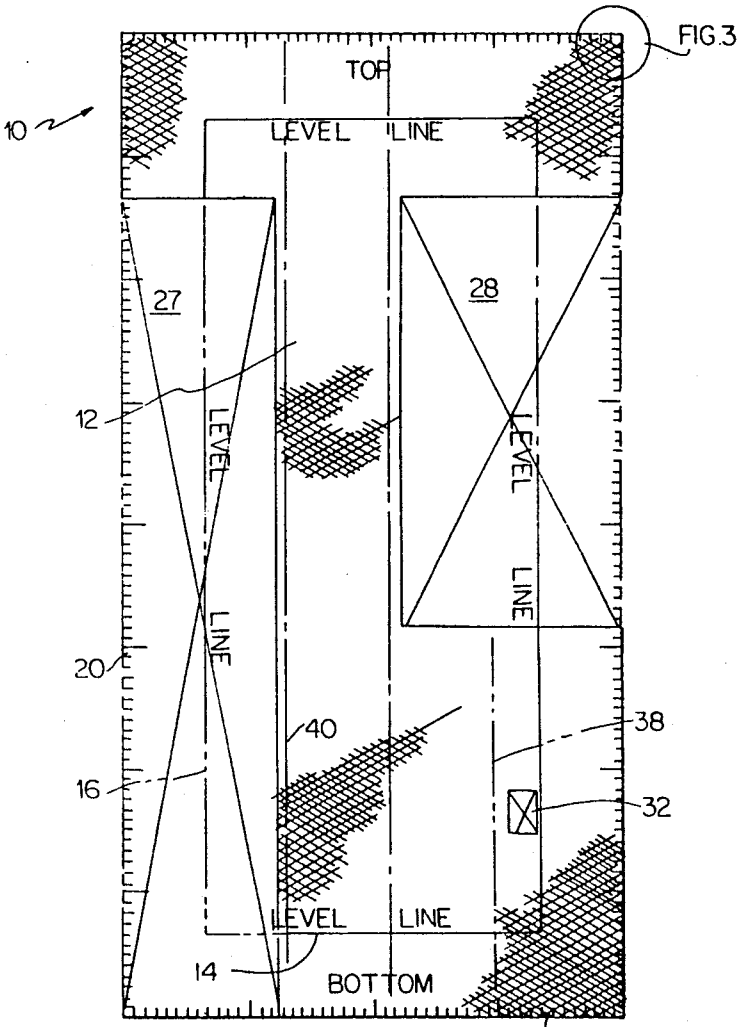
FIG.2
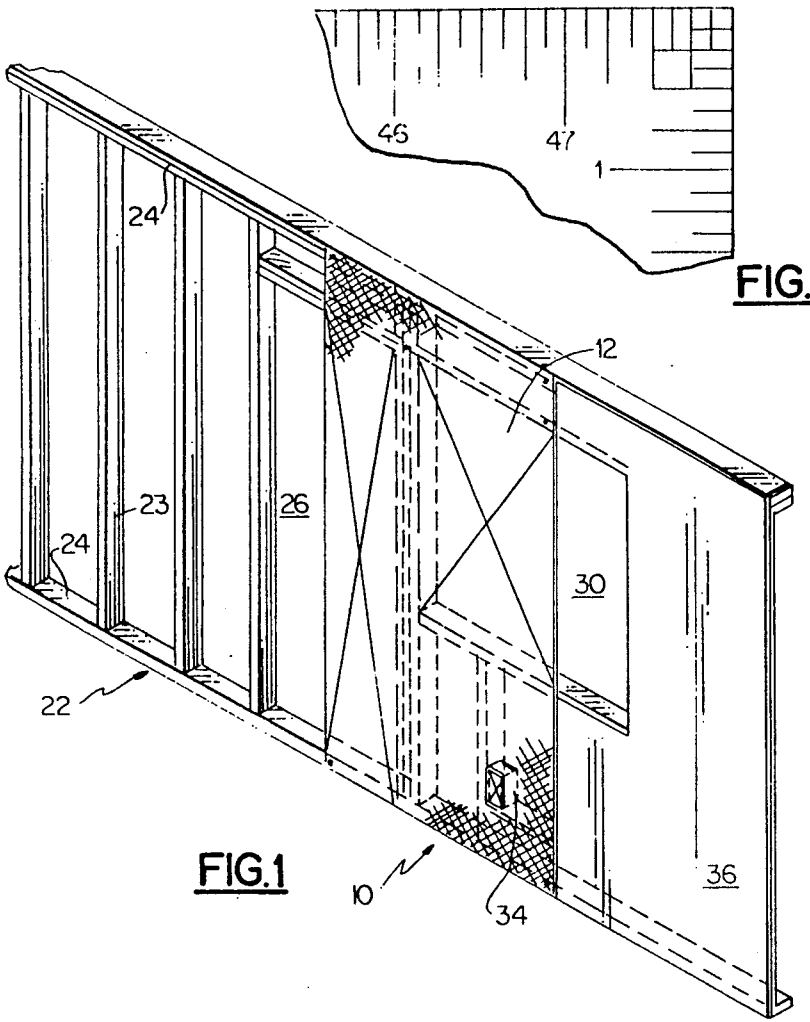
FIG.3
FIG.1

WALL PANEL TEMPLATE

BACKGROUND OF THE INVENTION

In the modern building construction industry the technique of utilizing panels of standard size in the fabrication of walls, both interior and exterior, roofs, and other building components is now the accepted practice. Today the construction industry uses standard panels for sheet rock, plywood, wood paneling, exterior sheathing, roofing, etc. Standard panel sizes start at about 4'×8' and include 4'×10' and 4'×12' sheets for many applications. One difficulty encountered with sheets of this type is that in certain areas they must be cut out or trimmed to accommodate doors, windows and appliance openings such as electrical outlet boxes, lights and similar items. In addtion, "out of square" conditions in older buildings, particularly must be accommodated. Traditionally, the carpenter has taken multiple measurements of the locations of these cut outs, and marked them off on a panel and cut the panel to fit. This has been time consuming and error prone, although not impossible of accomplishment. An additional problem encountered in the use of paneling has been the location of studs particularly with larger panels.

SUMMARY AND OBJECTS OF THE INVENTION

Accordingly, it is an object of the present invention to provide means for overcoming limitations of the prior art.

It is another object of the present invention to provide a template on which the desired cutouts and trimming operations can be marked and which can then be readily transferred to the panel to be installed on a construction project.

It is still a further object of the present invention to provide an inexpensive, easy to use, disposable paper template which can be easily installed on a work area, the necessary operations marked on the template, and the template removed and placed on a panel for transfer of the marked information so that the panel can be cutout to match the wall configuration to which it is to be applied.

It is a still further object of the present invention to provide a template that can be fixed over a work area and cut out and trimmed to the desired size and shape for a panel to be installed in said work area and said template than used to cut a panel to the desired configuration.

These and other and further objects are attained in one embodiment by the provision of a template made of a thin piece of semi transparent paper measuring 4'×8', having "level lines" marked thereon parallel to both length and width edges and "measurement scales" marked along the edges of the template so that trim areas and cutouts can be indicated by a marking device or by cutting out selected areas.

DETAILED DESCRIPTION OF THE DRAWINGS

In order to describe my invention in greater detail, reference is made to the attached drawings, wherein FIG. 1 is a partial perspective view of a typical wall construction showing the template in use;

FIG. 2 is a plan view of the template of the present invention and;

FIG. 3 is an enlarged detail of the upper right hand corner of FIG. 2.

DESCRIPTION OF A PREFERRED EMBODIMENT

Figure 4:
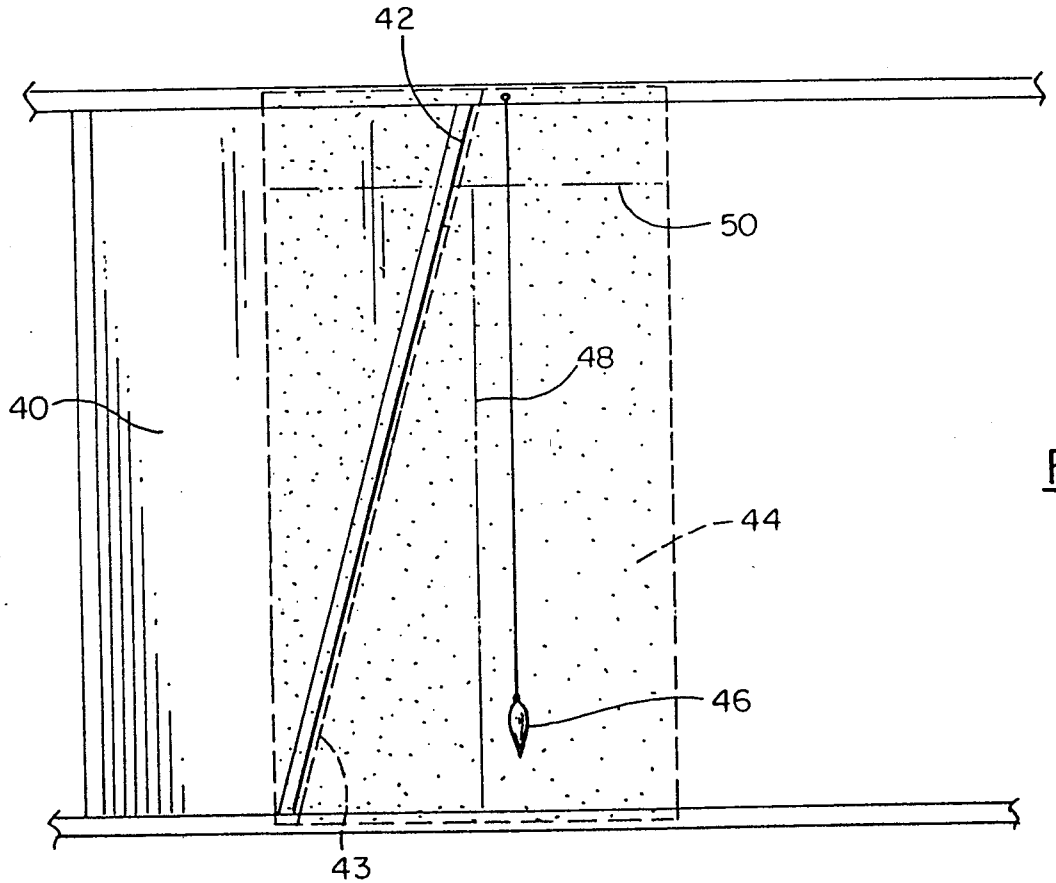
FIG. 4 is a view similar to FIG. 1 showing the template applied to an out of square condition.

Referring now to FIG. 2, the template 10 according to the present invention comprises a sheet of paper 12, which in one configuration measures 4' across the top and 8' along the sides. The paper is a light weight semi-transparent or translucent paper (typically **201*b* anti-tarnish tissue) and has marked thereon level and plumb lines and measurement scales. A pair of horizontal level lines 14 spaced inwardly from the top and bottom edges thereof, and a pair of vertical plumb lines 16 spaced inwardly from the sides are marked on the paper parallel to the edges. Also marked on the template paper 12 on the top and bottom edges are a pair of measuring scales 18 which are calibrated generally in inches and are shown from 1 to 48 inches. Along the sides a second pair of measuring scales 20 are marked extending generally from 1 to 96 inches. These divisions may be seen in more detail in FIG. 3 which is a fragmentary view of the upper right hand corner of FIG. 2**. These scales, while shown positioned along the edges may be marked at any convenient place along the template as desired.

Referring now to FIG. 1, the template 10 is shown applied to a wall 22 of a building which is typically formed with a plurality of vertical stud members 23 and top and bottom plates 24. The vertical studs are generally spaced apart either 16" on center or 24" on center depending on the application. As may be seen in FIG. 1, the template 10 is affixed to the wall structure and aligned (by tacks or tape, not shown) with one or both of the level lines so that the template is properly aligned on the wall panel. In FIG. 1 a first panel 36 has already been applied to the wall. The template 10 is shown in position in the space where the next panel to the left will be applied. As can be seen the panel 36 has a cutout to accommodate the window 30 and since the template 10 is positioned in the place where the next panel will go the balance of the window 30 can be easily and quickly marked off on the template paper 12 by pencil, crayon or by simply cutting out the space marked with the X in FIG. 1 and indicated as the space 28 in FIG. 2. Similarly the doorway opening portion to be cut out of the next panel to accommodate the doorway 26 is marked and indicated (with the narrow elongated X) as space 27 on the template in FIG. 2. Again this can be marked with crayon, pencil or actually cut out of the pattern as desired.

Also shown in FIGS. 1 and 2, is the marking 32 for the cutout of the space to accommodate the electrical outlet box 34 shown in FIG. 1. After the necessary cutouts are marked on the template 10 in FIG. 1, the paper 12 is removed from the wall and superimposed on a panel to be installed on the wall and the trim and cutout markings transferred to the panel as is well known in the art for subsequent cutting of the panel. Once the cutouts 27, 28 and 32 have been marked on the panel, the template 10 can be removed, reused, or thrown away. The marked lines on the panel are cutout in the usual manner so as to prepare the panel for mounting next in line with the panel 36. In addition to the cutouts 27, 28, and 32 the template 10 can be marked when on the wall with the center lines of the studs and the lines such as 38 and 40 in FIG. 2 can be then transferred to the panel. This facilitates the nailing of the panel in place and eases the carpenter's job in positioning the nails so as to properly strike the studs and other wall members.

The template 10 is made by cutting a piece of the proper paper to the desired size and then marking on it the level and plumb lines and the marking scales and the legends top and bottom. Once this is done, the panel is folded generally in 1' sections parallel to the top and bottom in accordion fashion which results in a 1'×4' folded template This may then be folded again at right angles to the first folds into a 1'×1' square assembly for ease of handling, transportation, etc.

Referring now to FIG. 4, there is shown another embodiment of my present invention. In some applications a rectangular panel cannot be applied without trimming at least one edge to accept an out of plumb or square condition. FIG. 4 shows in exaggerated fashion a panel 40 which has the right-hand edges 42 at an angle other than 90° to the top and bottom. A template 44 according to the present invention can be simply installed on the wall as shown in dotted lines in FIG. 4. The template 44 is aligned in the space by dropping a plumb bob 46 so as to match a vertical plumb line 48 on the template 44. Alternatively, a spirit level may be used with horizontal level line 50 to properly orient the template 44. For sake of clarity of explanation, the plumb bob 46 is shown displaced from, but parallel to plumb line 48. In actual use, it generally would be superimposed. After proper alignment a line 43 can be cut in the template 44 to match the edge 42 of the panel 40 already installed. The trimmed template 44 may then be placed on the next panel to be installed and the line 42 marked and the panel to be installed cut to accommodate the "out of square" condition.

While I have described the template as generally corresponding in size and shape to the panel to be installed, the template may actually be of any appropriate size and shape so that when positioned over a wall, it can be cut to the desired size and shape and the balance discarded. The pattern thus formed is used to cut the panel to be installed to the proper size and shape to fit the opening.

It should also be understood that while I have described building panels such as plasterboard and wood paneling, the present invention applies equally well to wall coverings such as wall paper, fabric, and the like.

I have thus shown a template that is economical to manufacture, can be simply and easily used, and can be discarded after each use or after several uses, as the case may be. The paper is light, easy to use, and cheap to manufacture. The template being translucent permits ready location of components underneath so as to facilitate marking, and cutting of the template and panel to be installed.

While the invention has been described in detail with reference to a single preferred embodiment, it should be apparent that many modifications and variations would present themselves to those skilled in the art without departing from the scope and spirit of this invention, as defined in the appended claims.

What is claimed is:

1. A method of cutting out and trimming a panel to be affixed to a structure so that it will fit in a selected area and position which comprises:

providing a thin planar sheet of material having a size at least equal to the panel to be installed on the structure and having at least one horizontal level line and one vertical plumb line marked thereon;

positioning said sheet of material on the structure so as to cover and overlap the area in which the panel is to be installed;

establishing a reference line on the structure on which the panel is to be installed in a direction selected from the group of horizontal and vertical;

aligning one of said horizontal level line or vertical plumb line on said sheet of material with said reference line;

cutting said aligned sheet of material along the edges of the area in which the panel is to be installed to form a template matching exactly said area;

positioning said template on a panel to be cut out and trimmed; and cutting said panel to the size and shape indicated by said template;

so that the panel may be accurately fitted into the desired area of said building structure.

2. The method of claim 1, wherein said steps of positioning said template and cutting said panel are further performed upon a second panel, whereby said second panel can be installed adjacent said panel to accommodate an out of square condition.

3. A method of cutting out and trimming a panel to be affixed to a structure so that it will fit in a selected area and position which comprises:

providing a thin planar sheet of material having a size at least equal to the panel to be installed on the structure and having orientation lines marked thereon, said orientation lines comprising a horizontal level line and a vertical plumb line;

positioning said sheet of material on the structure so as to cover and overlap the area in which the panel is to be installed;

established a reference line on the structure on which the panel is to be installed in a direction selected from the group of horizontal and vertical;

aligning one of said orientation lines with said reference line;

marking borders of said area on said sheet of material to define a template that matches said area;

positioning said template on a panel to be cut out and trimmed; and cutting said panel to the size and shape indicated by said template;

so that the panel may be accurately fitted into the desired area of said building structure.

* * * * *